US005387320A

United States Patent [19]

Jaakkola

[11] Patent Number: 5,387,320

[45] Date of Patent: Feb. 7, 1995

[54] TWIN-WIRE WEB FORMER IN A PAPER MACHINE

[75] Inventor: Jyrki Jaakkola, Korpilahti, Finland

[73] Assignee: Valmet Paper Machinery, Inc., Helsinki

[21] Appl. No.: 903,603

[22] Filed: Jun. 24, 1992

[30] Foreign Application Priority Data

Jun. 26, 1991 [FI] Finland ..... 913112

[51] Int. Cl.[6] ..... D21F 1/00; D21F 1/54; D21F 1/48

[52] U.S. Cl. ..... 162/301; 162/352; 162/374

[58] Field of Search ..... 162/300, 301, 352, 374

[56] References Cited

U.S. PATENT DOCUMENTS

| | | | |
|---|---|---|---|
| 3,585,105 | 6/1971 | Stuebe | 162/352 |
| 4,769,111 | 9/1988 | Nevalainen et al. | 162/351 |
| 4,988,408 | 1/1991 | Evalahti | 162/301 |
| 5,045,153 | 9/1991 | Sollinger et al. | 162/352 |
| 5,061,347 | 10/1991 | Bubik et al. | 162/352 |
| 5,076,894 | 12/1991 | Simmons | 162/352 |
| 5,167,770 | 12/1992 | Bubik et al. | 162/301 |
| 5,185,064 | 2/1993 | Nyman | 162/301 |
| 5,262,010 | 11/1993 | Bubik et al. | 162/301 |

FOREIGN PATENT DOCUMENTS

| | | |
|---|---|---|
| 0251778 | 1/1988 | European Pat. Off. . |
| 0438681 | 7/1991 | European Pat. Off. . |
| 885607 | 12/1988 | Finland . |
| 885606 | 6/1990 | Finland . |
| 904489 | 9/1990 | Finland . |
| 903374 | 3/1991 | Finland . |
| 911281 | 3/1991 | Finland . |
| 910362 | 7/1991 | Finland . |
| 910830 | 8/1991 | Finland . |
| 84638 | 9/1991 | Finland . |
| 2531839 | 2/1976 | Germany . |
| 881688 | 11/1961 | United Kingdom . |
| 1225517 | 3/1971 | United Kingdom . |
| 2174120 | 10/1986 | United Kingdom . |
| 9102842 | 7/1991 | WIPO . |

OTHER PUBLICATIONS

"Twin-Former SP-das fortschrittliche Hybridformer-system mit universellem Einsatzbereich", J. Schweiger and A. Bubik, Wochenblatt Fur Papierfabrikation Sep. 1991, pp. 323-329.

*Primary Examiner*—Karen M. Hastings
*Attorney, Agent, or Firm*—Steinberg, Raskin & Davidson

[57] ABSTRACT

The invention concerns a twin-wire web former in a paper machine, comprising a carrying wire and a covering wire which together form a twin-wire forming zone. In this forming zone, a forming unit is fitted, which comprises a forming board and a drainage box placed one opposite the other. In the forming board placed facing the drainage box there are a number of transverse loading ribs placed at a distance from each other. Subsequent transverse loading ribs are interconnected by intermediate parts which, together with the transverse loading ribs form ribbed shoes. These shoes can be loaded by means of loading hoses to produce a dewatering pressure in the web (W) placed between the wires. In the area of the forming unit the dewatering takes place both through the covering wire and through the carrying wire also toward the forming board through the open spaces placed between its transverse loading ribs.

20 Claims, 8 Drawing Sheets 10
17
Wo
F
20
18
52
50
54c
55c
41
44
54b
55b
41
10
54a
55a
53
51
33
30
19
Kao
10
Wo
16
10a
K
J
20b 10
17
18
50
10
19
16
10a
K
Wo
10
Kao
Wo
F
20
52
54c
55c
54b
55b
R2
54a
55a
51
41
44
41
53
33
30

TWIN-WIRE WEB FORMER IN A PAPER MACHINE

BACKGROUND OF THE INVENTION

The invention concerns a twin-wire web former in a paper machine comprising a carrying wire and a covering wire, which together form a twin-wire forming zone, in which a forming unit is fitted. The forming unit comprises a forming board and a drainage box placed one opposite the other. The drainage box comprises a number of ribs and spaces between these ribs through which water is drained out of a web running between the carrying and covering wires. The water drains out through the spaces between these ribs to a significant extent by the effect of negative pressure into the drainage box.

With increasing running speeds of paper machines, several problems in the web formation have been manifested with more emphasis. The phenomena, such as centrifugal forces which affect both the fiber mesh in the former of the paper machine and the water, which is still relatively free in connection with the fiber mesh, are usually increased in proportion to the second power of the web speed. The highest web speeds of most modern paper machines are of an order of about 1200 m/min. However, machines are being planned in which the intended web speed is as high as about 1700 m/min.

With respect to prior art related to the present invention, reference is made to U.S. Pat. No. 4,769,111, granted to A. Ahlstrom Corp.; to the assignee's FI Pat. Appl. No. 885609, and to FI Pat. Appls. Nos. 885606 and 885607 of Valmet-Ahlstrom Inc., wherein web formers marketed by the assignee under the trade mark "MB-Former" are described.

Further, reference is made to the assignee's FI Pat. Appls. 904489 (filed Sep. 12, 1990) and 911281 (filed Mar. 15, 1991), wherein various combinations of the above MB-former unit or units and hybrid and gap formers are described.

In the prior art MB-formers, the lower unit consists of a support board, which comprises relatively wide transverse ribs. Each of these ribs are loaded separately by means of a loading hose. The top side of the ribs is placed against the inner face of the lower wire and is provided with grooves running across the face in the longitudinal direction of the ribs. The function of the water gathered in these grooves is mainly to lower the friction between the lower wire and the ribs. It is a drawback of this prior art support board that the downward draining from the web is almost completely prevented. This is because water can drain only to a limited extent into the narrow and shallow grooves on the ribs. From these grooves the water can flow to the sides only.

In particular when a MB-unit or units are fitted, e.g., in accordance with the assignee's FI Pat. Appl. 904489, in a high-speed and wide gap former (the assignee's "HHS-former"=trade mark), the narrow and shallow grooves on the ribs in the support board are not adequate to remove the relatively large quantities of water. In the prior art MB-units, the draining takes place practically exclusively upwards towards the upper drainage box, aided by suction. Thus, in the prior art constructions, the formation of the web cannot be affected sufficiently by means of a MB-unit. This is because the fibrous web must be relatively dry when it arrives in the twin-wire forming zone in the MB-unit. As a result, the fibers in the web can no longer be displaced to a sufficient extent in relation to one another.

In the prior art, in the manufacture of certain paper grades, a coloring agent is added to the paper pulp. However, when the prior art MB-units are employed, this coloring agent is washed along with the water that is drained upwards, to a greater extent to the top face of the web. On the other hand, when attempts have been made in prior art former solutions to drain a higher proportion of water downwards to provide a better balance of color, the consequence has been inferior formation of the paper.

OBJECTS AND SUMMARY OF THE INVENTION

An object of the invention is to provide a former in which the web forming process as a whole is under improved control such that the particular requirements of the paper grade that is being produced can be taken into account in the process.

Another object of the present invention is the further development of prior art MB-formers and of their combinations with hybrid and/or gap formers so that the MB-unit can be freely located, usually such that the MB-unit can be fitted at a point in the web forming process at which the dry solids content of the web is lower than in the prior art.

A further object of the invention is to provide a former that has an increased draining capacity, which can be utilized as an increased web speed, as a thicker grade produced or as a lower consistency in the headbox, which in itself already helps to improve many properties of paper.

It is a further object of the invention to provide a former, in particular a high-speed gap former, that is suitable in particular for the production of fine papers whose grammage is higher than about 40 g/m$^2$ and when the speed of the paper machine is higher than about 1000 m/min, even of an order of about 1400 to about 1700 m/min.

It is a further object of the invention to provide a former with which the fine paper or printing paper produced has an improved balance of colors.

It is a further object of the invention to provide an improved construction of the MB-former in which the ratio of the draining taking place upwards and downwards can be better controlled than in prior art.

It is a further object of the invention to improve the balance of colors and/or the balance of fillers by removing water in substantially equal amounts both upwards and downwards in the twin-wire forming zone of the MB-unit.

A further object of the present invention is to arrange that the draining is symmetric within the whole former. For example, when the suction in the forming roll is altered, the balance of draining can be maintained by adjusting the direction of draining.

In view of achieving the objectives stated above, those that will come out later, and others, in the present invention a number of transverse loading ribs in the forming board are placed facing the drainage box and at a distance from each other in the machine direction, which can be the direction of travel of the web. These transverse loading ribs are interconnected by intermediate parts. The intermediate parts together with the loading ribs attached to them, form ribbed shoes. The ribbed shoes can be loaded by means of loading hoses to produce a dewatering pressure in the web placed between the wires. The transverse loading ribs on the drainage box operate as back-up members for the loading forces. In the area of the forming unit, the dewatering can be arranged as taking place both through the covering wire and through the carrying wire, and also towards the forming board through the open spaces placed between the transverse loading ribs.

In the invention, the forming board comprises ribbed shoes placed one after the other. The ribbed shoes include interconnected loading ribs, preferably in pairs. The drainage downwards can take place through the open spaces between these loading ribs by the effect of gravity or, if necessary, also as intensified by negative pressure.

In accordance with the present invention, such a construction in which the ribbed shoe in the forming board comprises a pair of loading ribs is particularly advantageous. At each of the transverse loading ribs a loading hose is fitted and into each of these loading hoses an adjustable pressure can be passed so as to adjust the loading force of the ribbed shoe. Since the wire moving against the loading ribs produces forces on the ribbed shoes, the ribbed shoes must be supported. In the invention, the ribbed shoes are supported advantageously so that the support results in a minimal torque that attempts to turn the ribbed shoe.

The invention can be applied both to gap formers and to hybrid formers that have a single-wire initial portion of the forming zone. This single-wire forming zone is followed by a twin-wire forming zone provided with one or several forming units in accordance with the invention.

In an embodiment of the invention, the twin-wire forming zone is preferably straight at the forming unit. The invention may also be accomplished such that the twin-wire forming zone is curved either towards the drainage box of the forming unit or towards the forming board in accordance with the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
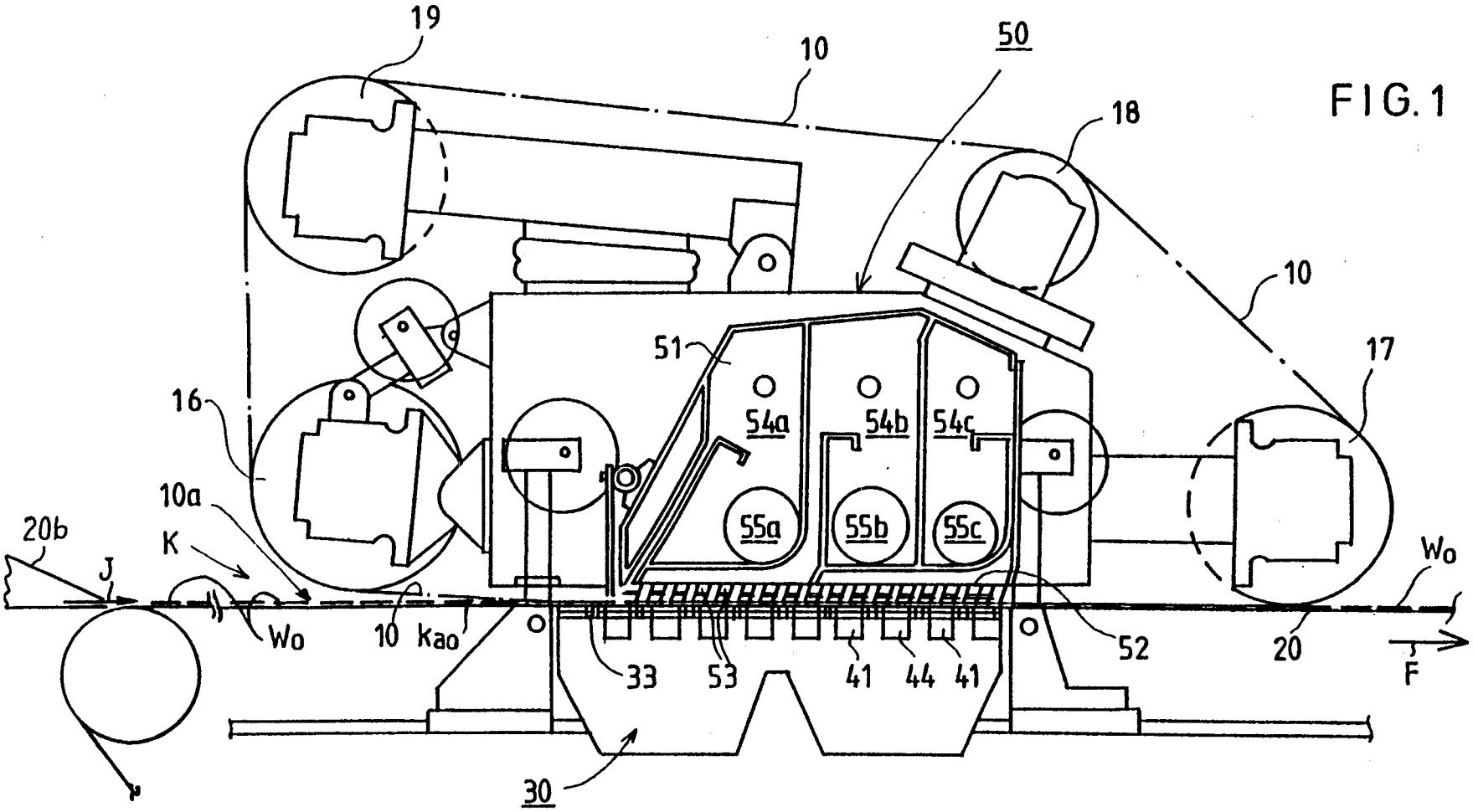
FIG. 1 is a schematic side view of a fourdrinier former provided with a MB-unit in accordance with the invention.

FIG. 1 is a schematic side view of the twin-wire part of the former of a paper machine, wherein the upper wire 10 is arranged to run over the guide rolls 16, 17, 18 and 19 and wherein the lower wire 20 runs underneath the upper wire 10 and is substantially parallel to the upper wire 10. The wires 10 and 20 form a wedge-shaped inlet gap K, wherein the web $W_o$ placed on the lower wire 20 is constantly pressed between the wires 10 and 20 as they make progress.

On the single-wire initial portion 10*a* of the lower wire 20, the pulp suspension J is fed out of the discharge opening of the headbox 20*b* to form a web $W_o$ has been drained such that its dry solids content $ka_o$ is preferably in a range from about $ka_o=0.7\%$ to about $ka_o=2.5\%$ With the prior art MB-units, the dry solids content has usually been in a range from about $ka_o=1.5\%$ to about $ka_o=2.5\%$. By means of the MB-unit in accordance with the invention, it is possible to place the MB-unit in an area optimally in view of the draining and formation processes, and also closer to the lip of the headbox. For example, the MB-unit can be placed in an area where the dry solids content of the web $W_o$ is from about $ka_o=0.9\%$ to about $ka_o=1.5\%$.

After the wedge-shaped inlet gap K, in the transfer direction F, there is a MB-unit 50, which comprises a drainage box 51. The bottom 52 of the drainage box 51 consists of ribs 53. Water is sucked out of the web $W_o$ through the gaps placed between the ribs 53 and into the drainage box 51 by means of negative pressure. The upper wire 10 rests against the ribs 53 as it runs through the MB-unit. Furthermore, FIG. 1 shows several other parts and adjusting members included in the former. These parts and members are in themselves known and will not be described in more detail in this connection.

According to FIG. 1, the drainage box 51 comprises three chambers 54*a*, 54*b*, 54*c*, in which negative pressure prevails. By means of this negative pressure, water is sucked out of the web $W_o$ and into the three chambers 54*a*, 54*b*, 54*c*. The negative pressure and the removal of the water out of the chambers 54*a*, 54*b*, 54*c* are produced through the pipes 55*a*, 55*b* and 55*c*. In different chambers, negative pressures of different levels are preferably employed.

The MB-unit 50 includes a novel forming board 30 in accordance with the invention. The forming board 30 permits draining downwards, and is shown in FIG. 1 schematically. The construction of the forming board 30 will be described in detail later with reference to FIGS. 3 to 8.

Figure 2:
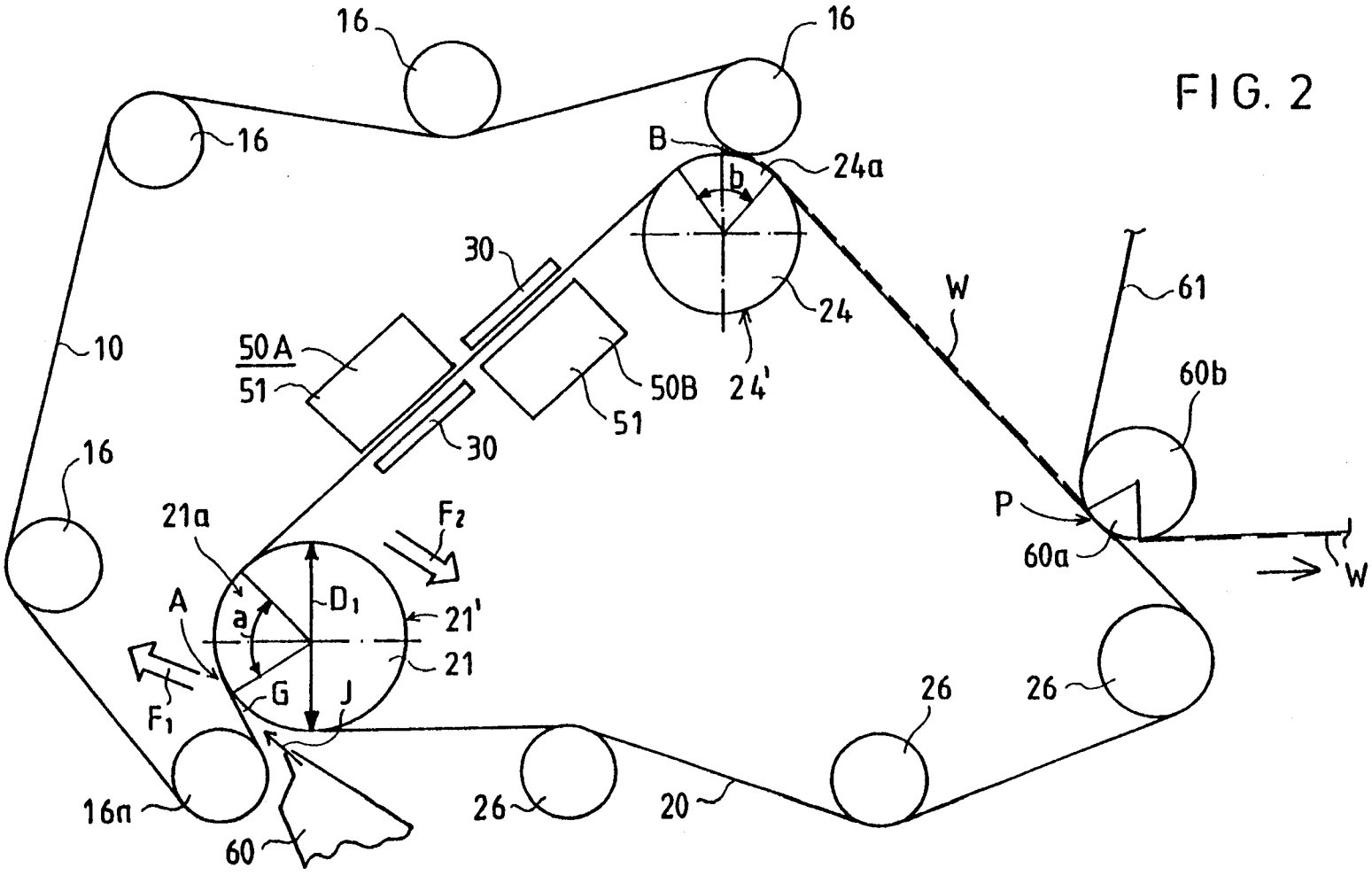
FIG. 2 shows a high-speed gap former that is provided with two MB-units in accordance with the invention placed one after the other.

The high-speed gap former shown in FIG. 2 comprises the loop of the covering wire 10 and the loop of the carrying wire 20. The wires 10, 20 have a joint run between the lines A and B, these lines limiting the twin-wire forming zone of the former. The web W follows the carrying wire 20 after the twin-wire forming zone A–B. The slice part 60 of the headbox feeds a pulp jet J into the forming gap G between the wires 10, 20. The forming gap G is, at one side, defined substantially by the run of the wire 10 from the roll 16*a* to the line A, where the wire 10 meets the other wire 20 and as a result the pulp layer is placed in between. At the other side, the forming gap G is defined by the wire 20 which runs over the first forming roll 21. According to FIG. 2, the first forming roll 21 is a forming roll which is provided with an open face 21', which has a relatively large diameter $D_1$, and which is provided with a suction box 21*a*. On the sector a of the first forming roll 21, the draining takes place substantially away from the forming roll 21 in the direction of the arrow $F_1$ and to some extent into the open face 21' of the roll 21.

Figure 9:
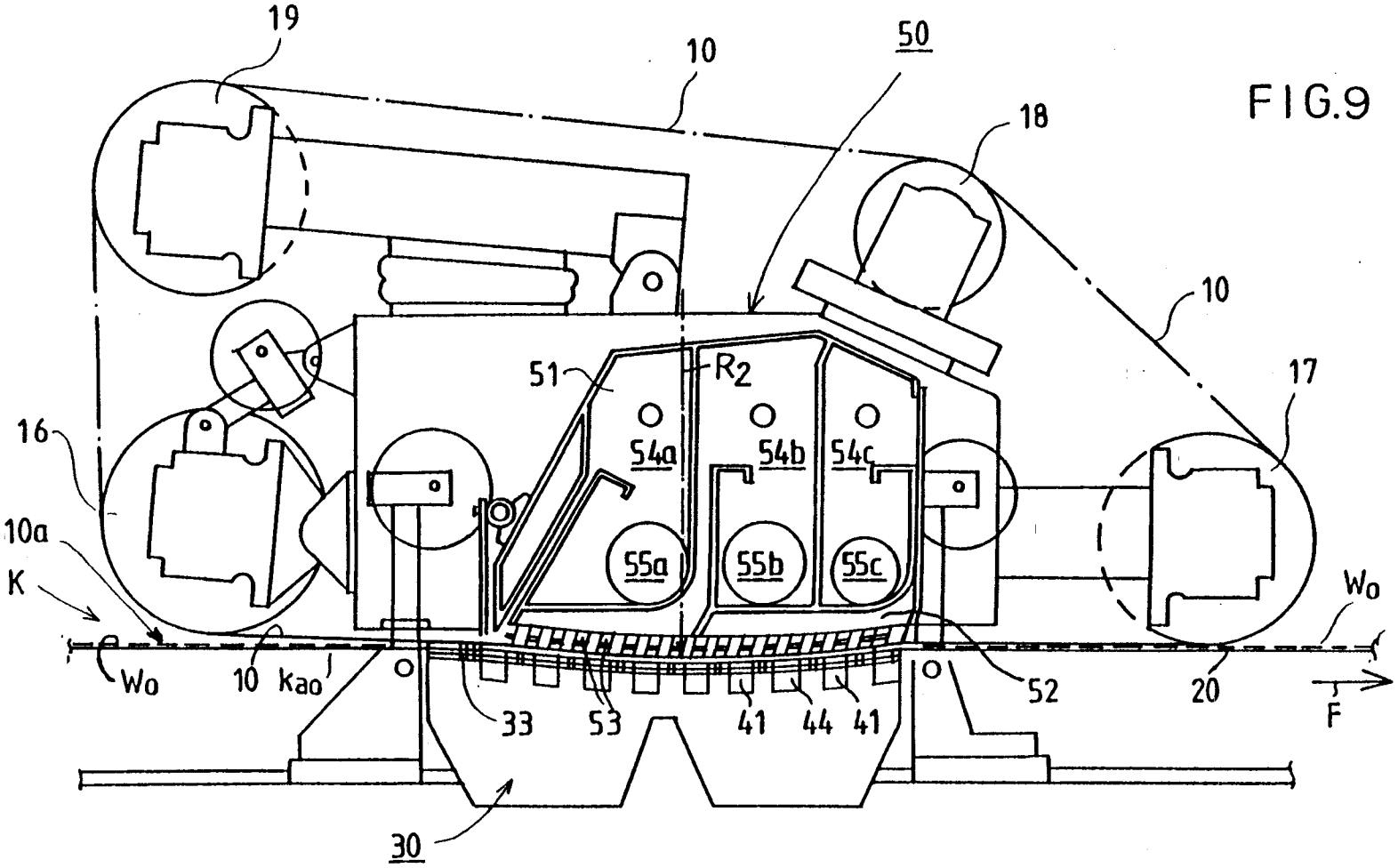
FIG. 9 is an embodiment of the present invention similar to that of FIG. 1 and having a curved forming zone.
Figure 10:
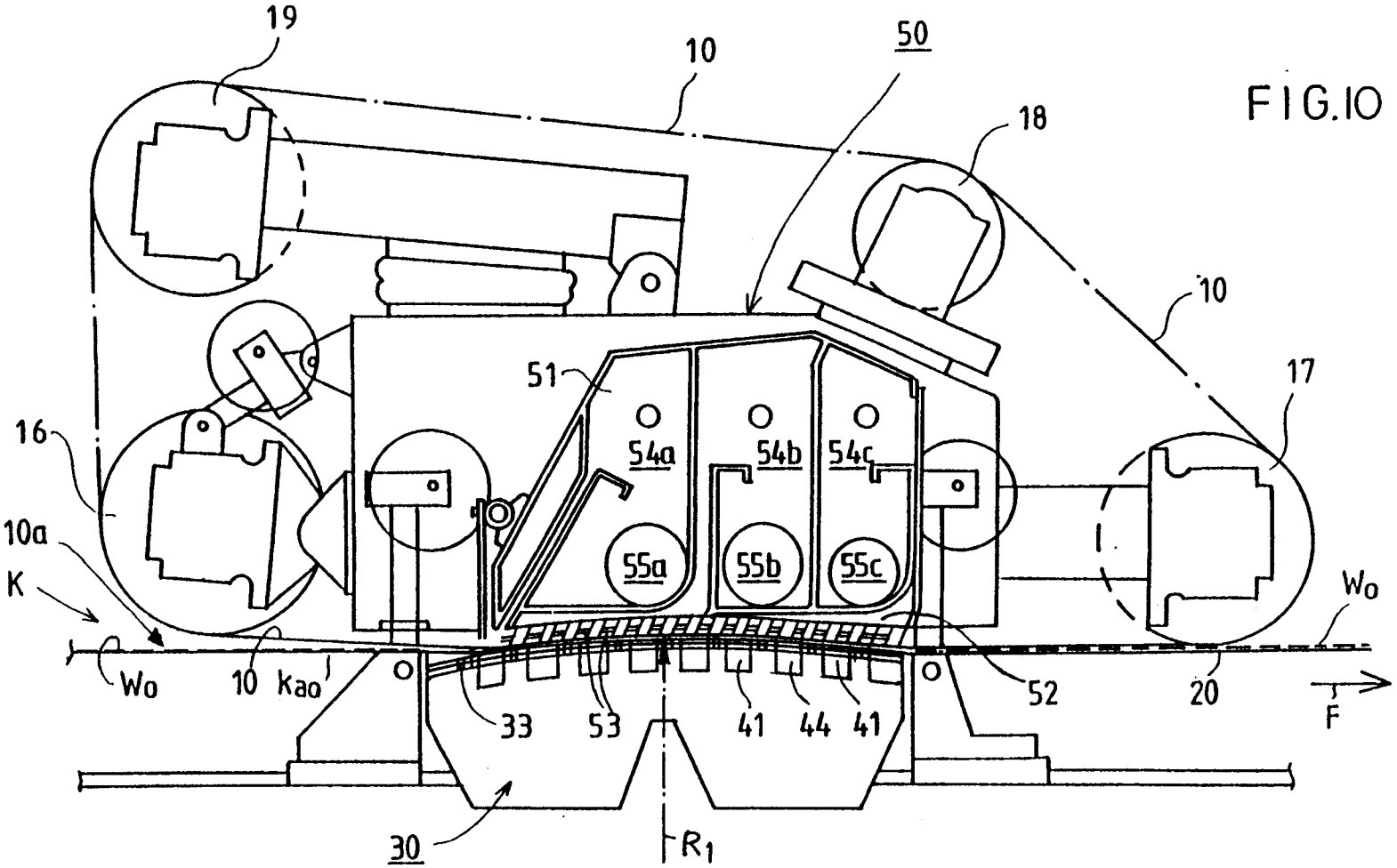
FIG. 10 is another embodiment of the present invention similar to that of FIG. 1 and having a curved forming zone.

As an important part, the twin-wire former shown in FIG. 2 includes two MB-units 50A and 50B placed one after the other. The MB-units 50A and 50B comprise drainage boxes 51 and novel forming boards 30 in accordance with the present invention. The forming boards operate as press and drainage units. The wires 10 and 20 and the web W placed between them running between the drainage box 51 and the forming boards 30. In the first MB-unit 50A, the drainage box 51 is placed above and inside the loop of the upper wire 10, and the forming board 30 is placed below and inside the loop of the lower wire 20. In the second MB-unit 50B, the drainage box 51 is placed below and inside the loop of the lower wire 20, and the forming board 30 is placed above and inside the loop of the upper wire 10. The twin-wire zone runs through the units 50A and 50B as a straight run so that drainage takes place in both MB-units 50A and 50B both through the upper wire 10 and through the lower wire 20. In another embodiment of the present invention, as shown in FIGS. 9 and 10 the units 50A and 50B may also be arranged so that the twin-wire zone is curved in the area of these units or unit. In FIG. 9, the twin-wire forming zone is curved and has a radius of curvature $R_2$ at a side of the drainage box of the forming unit. In FIG. 10, the forming zone is curved and has a radius of curvature $R_1$ at a side of the forming board. In other respects, the elements of FIGS. 9 and 10 are identical to those described with respect to FIG. 1. In another embodiment, the units 50A and 50B may also be substituted for by one unit 50, in which case the drainage box 51 is preferably placed above and inside the loop of the covering wire 10.

Referring to FIG. 2, the MB-unit or units 50A, 50B is/are followed by a second forming roll 24, which is placed inside the loop of the carrying wire 20. In sector b on the second forming roll 24, the run of the wires 10, 20 is turned to be curved towards the pick-up point. After the second forming roll 24, the web W proceeds to the line P, at which point it is separated from the wire 20 by means of the pick-up roll 60*b* and its suction zone 60*a*. The web is then transferred onto the pick-up fabric 61, which carries the web W further to the press section (not shown) of the paper machine.

Figure 3:
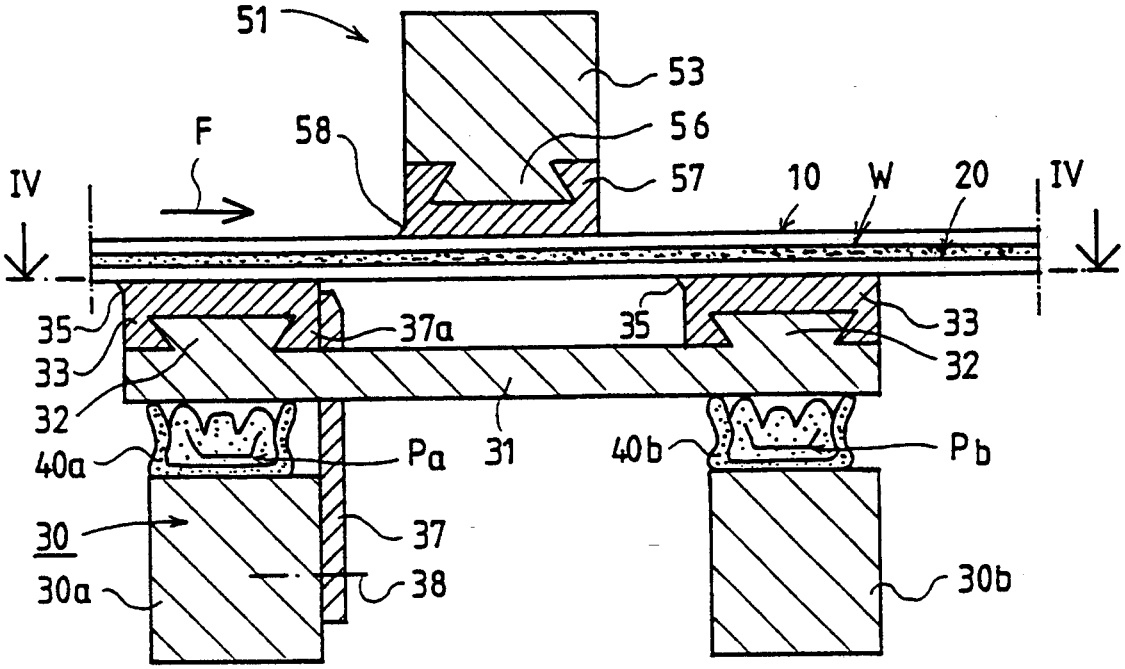
FIG. 3 is a vertical sectional view in the machine direction of a loading member of a forming board in accordance with the invention.

The loading member of the forming board 30 of the MB-unit 50 shown in FIG. 3 comprises transverse frame parts 30*a* and 30*b*. On the top sides of these frame parts 30*a*, 30*b*, the ribbed shoe is supported by means of pressure-loaded hoses 40*a* and 40*b*. The ribbed shoe comprises a number of ribs 31 in the machine direction which connect the transverse loading ribs 33 only in pairs (i.e., each transverse loading rib is connected to only one other transverse loading rib) and are arranged such that openings 36 remaining between the ribs. To the ribs 31, transverse loading ribs 33 have been attached by means of dovetail joints 32 or the equivalent. The plane top sides of the transverse loading ribs 33 drag, while water operates as the lubricant fluid in the former as shown in FIG. 1. Against the inner face of the loop of the lower wire 20, the plane top sides of the transverse loading ribs 33 load the inner face of the wire upwards with the force determined by the pressure $p_a$, passed into the pair of hoses 40*a*, 40*b*. The top front edges of the transverse loading ribs 33 are provided with tip edges 35, which doctor water to be drained from the web W off the lower face of the wire 20. The ribbed shoe 31, 33 is supported in its place of operation by means of a number of vertical arms 37, which are attached to the frame part 30*a* by means of joints 38. The top ends 37*a* of the arms 37 are supported on the rear edge of the front rib 33, in the direction of transfer F of the wires 10, 20. The arms 37 keep the ribbed shoe 31, 33 in its position. The support point of the arms 37 is placed very high near the bottom face of the lower wire 20. For this reason, from the support, a minimal torque that attempts to turn the shoe is produced on the ribbed shoe 31, 33. Therefore, arms 37 function as link means which are arranged in proximity to a plane of the wire 20 (i.e., the twin-wire forming zone) to substantially prevent the generation of torque. In FIG. 3, only one upper rib 53 of the drainage box 51 in the MB-unit 50 is shown. A wear piece 57 is attached to the bottom side of the rib 53 means of a joint 56. The wear piece 57 is provided with a tip edge 58 that doctors water from the inner face of the upper wire 10.

Figure 4:
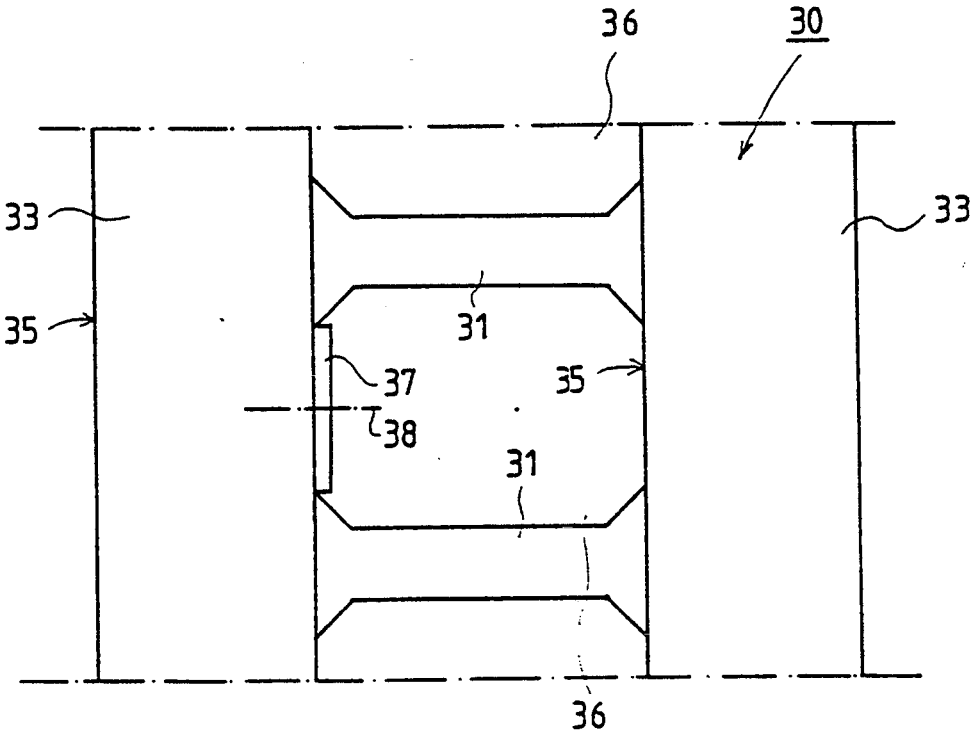
FIG. 4 is a sectional view taken along the line IV—IV in FIG. 3.
Figure 5:
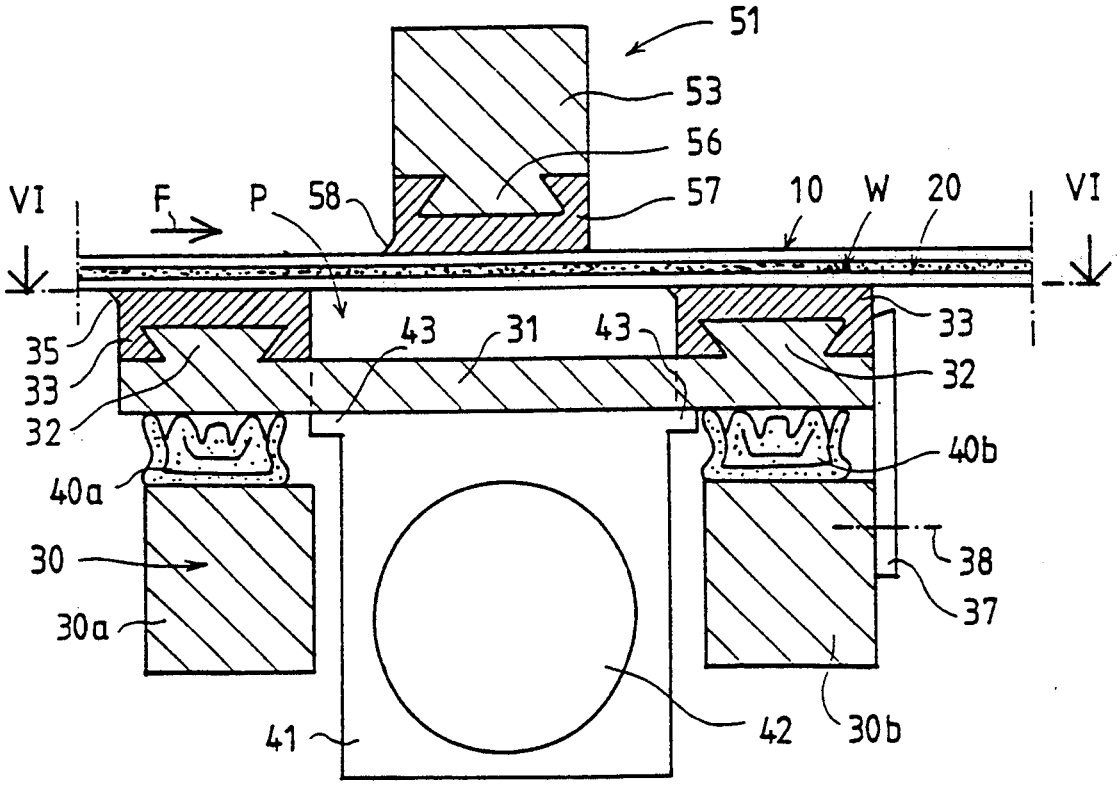
FIG. 5 shows a second exemplifying embodiment of the invention in a way corresponding to FIG. 3.
Figure 6:
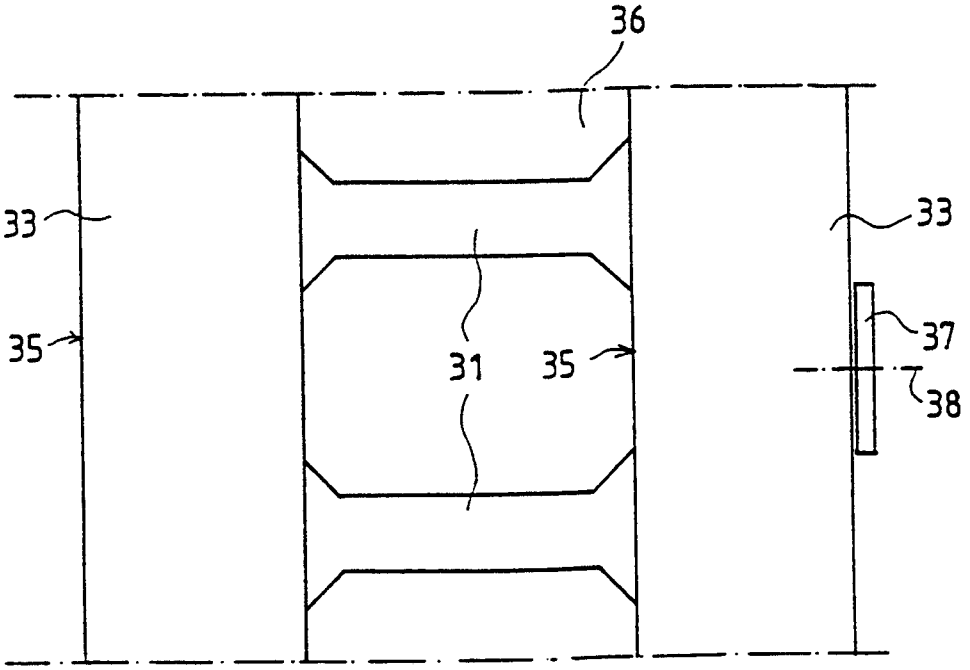
FIG. 6 is a sectional view taken along the line VI—VI in FIG. 5.

The ribbed-shoe construction shown in FIGS. 5 and 6 differs from that shown in FIGS. 3 and 4 in the respect that underneath the ribbed shoe 31, 33, a suction box 41 is placed. The suction box 41 is attached to the intermediate ribs 31 in the ribbed shoe by means of flanges 43. The suction box 41 is connected to a source of negative pressure through a flexible suction hose 42 so that, by the intermediate of the suction box 41, negative pressure p can be applied through the openings 36 between the ribs 31 to the space between the ribs 33, preferably from the side. By means of this negative pressure, the drainage down through the lower wire 20 is promoted.

Referring to FIGS. 5 and 6, the trailing edge of the rearmost rib 33 of the ribbed shoe 31, 33 is supported on the frame part 30*b* by means of a series of arms 37. By means of this construction, the support produces a minimum torque on the ribbed shoe 31, 33 when a torque is applied by the movement of the lower wire 20 to the ribbed shoe 31, 33.

Figure 7:
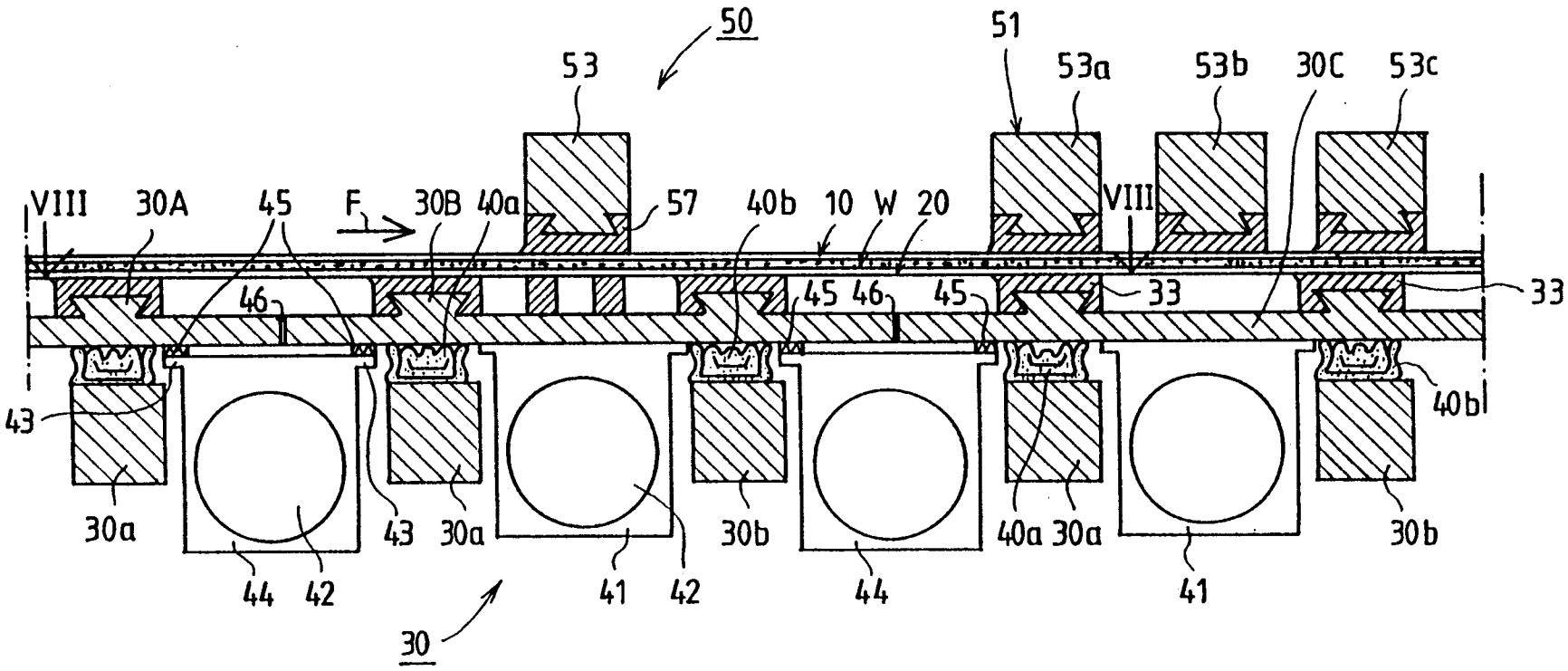
FIG. 7 is a vertical sectional view in the machine direction of a forming board in accordance with the invention.
Figure 8:
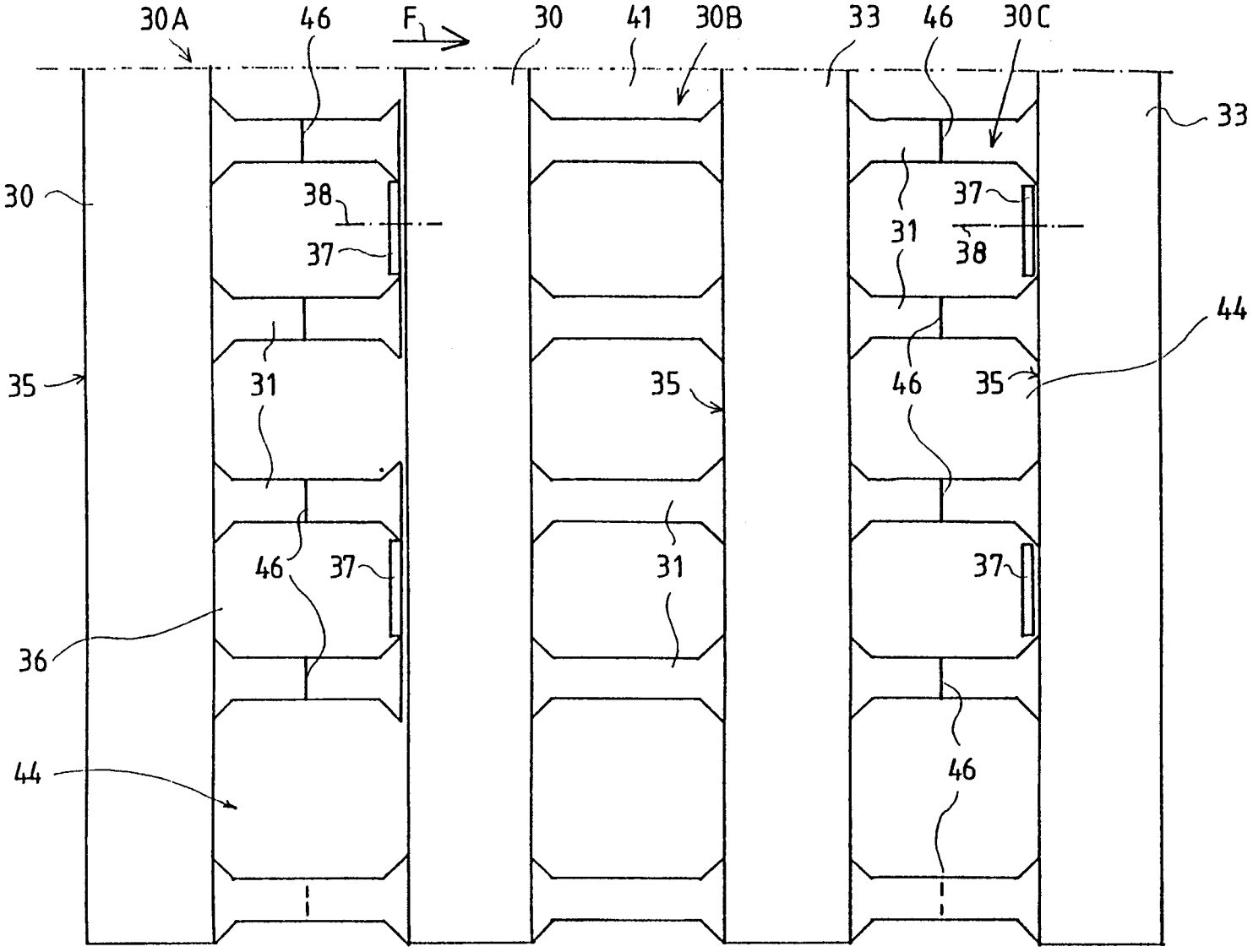
FIG. 8 is a sectional view taken along the line VIII—VIII in FIG. 7.

In FIGS. 7 and 8, a number of ribbed shoes 30A, 30B and 30C placed one after the other are shown. The suction boxes 41 described above in connection with FIGS. 5 and 6 are attached below the ribbed shoes 30A, 30B, 30C. The ribbed shoes 30A, 30B and 30C are separated from one another by a narrow transverse gap 46. Adjacent ribbed shoes are interconnected from underneath the gaps 46 between them by means of additional suction boxes 44. The flanges 43 at the top side of the suction boxes being provided with resilient seals 45 that permit a "play" of adjacent ribbed shoes 30A in relation to one another. By means of the suction boxes 44, an effect of negative pressure is applied to the web W through the lower wire 20 in the same way and for the same purpose as in the case of the fixed suction boxes 41. Moreover, in FIG. 7, facing the last ribbed shoe 30C, three subsequent ribs 53*a*, 53*b*, 53*c* of the drainage box 51 are seen. These subsequent ribs 53*a*, 53*b*, 53*c* are placed with relatively short mutual gaps in the machine direction. The first rib 53*a* is placed facing the rib 33 of the lower ribbed shoe. The last rib 53*c* is placed partially facing the next lower rib 33. The middle rib 53*b* is placed in the middle area between the ribs 33. The number of ribs 53 may also be some other suitable number different from three, placed one after the other.

In the following, important features of the operation of the ribbed shoes illustrated above in FIGS. 3 to 8 will be described.

From the point of view of the drainage and formation process, the MB-unit 50 in accordance with the invention operates differently than the prior art MB-unit. An important difference is the improved control and wider ranges of regulation of the drainage directions and water quantities.

In the present invention, the loading of the ribbed shoes takes place by means of two or more hoses 40*a*, 40*b*, between which there remain openings through which water can be allowed to drain downwards by the force of gravity and, if necessary, intensifying the drainage by means of negative pressure. The forces parallel to the wires 10, 20 are received by means of small support arms 37, which are placed as high as possible near the wire 20 in order that turning of the unit should be minimized. Through the openings 36 mentioned above, large quantities of water can be sucked down, in which case the MB-unit 50 can be placed at a location that is optimal in view of the manufacture of paper.

In this connection, it should be emphasized that, even though such formers have been described in which the run of the twin-wire zone at the MB-unit 50 is straight, the invention can also be accomplished so that the ribbed shoes 31, 33 of the forming board 30 are not in the same plane. In this embodiment, the guide planes of subsequent ribbed shoes are at a small angle in relation to one another, such that the run of the twin-wire zone is curved with the shape of a broken line with a relatively large curve radius. The ribs 53 of the drainage box 51 may also be arranged accordingly. In such a case, the curve radius of the twin-wire zone may be either at the side of the drainage box 51 or at the side of the forming board 30.

Owing to the novel forming board 30 in accordance with the invention, the water can drain downward equally well as upward. By means of the hoses 40*a*, 40*b*, the open ribbed shoe is loaded with a pressure from about 0.2 bar to about 0.4 bar. The drainage upwards is accomplished in the same way as in the prior art MB-formers.

The loading hoses 40*a* and 40*b* produce a pressure between the ribbed shoe 31, 33 and the frame part 30*a*, 30*b*, which pressure is applied to the inner face of the lower wire 20 by the intermediate of the top sides of the transverse loading ribs 33. By means of this pressure, the web W is pressed against the lower face of the upper wire 10. The back-up members of the upper wire 10 consist of the stationary ribs 53 of the drainage box 51. In this way, a dewatering compression is produced on the web W between the wires 10, 20 even if the runs of the wires 10, 20 were straight, in which case the pressure produced by tensioning of the wires 10, 20 cannot be converted to dewatering pressure. Underneath, the water drains through the openings 36 into the suction box 41, 44, whose dimension is, e.g., equal to that of two transverse loading ribs 33. The ribbed shoe 31, 33 may have a length larger than two transverse loading ribs 33 in the running direction F of the wires. In this case, a change in the thickness of the web W may require that a somewhat resilient material, e.g. a suitable durable plastic, is used for the ribbed shoe 31, 33.

The negative pressure is produced for the suction boxed 41, 44 from the side by means of a flexible hose 42. In this case the forces produced by the negative pressure are almost in balance, whereby the loading force of the transverse loading ribs 33 can be controlled irrespective of the negative pressure. Thus, the drainage can be altered from upward drainage to predominantly downward drainage by just regulating the levels of negative pressure in the suction boxes 41, 44. The control of the loading forces in the construction is quite easy. The drainage can be controlled by varying the pressure in the hoses 40*a*, 40*b*, by adjusting the levels of negative pressure, or by means of wire 10, 20 tensions when the twin-wire zone is curved.

The examples above are not meant to be exclusive. Many other variations of the present invention would be obvious to those skilled in the art, and are contemplated to be within the scope of the appended claims.

What is claimed is:

1. A twin-wire web former in a paper machine comprising a carrying wire, a covering wire, said carrying wire and said covering wire defining a twin-wire forming zone, a forming unit located in said twin-wire forming zone, said forming unit comprising a forming board located on one side of said carrying and said covering wires, said forming board having a plurality of transverse loading ribs and a plurality of ribbed shoes, each of said ribbed shoes comprising a pair of successively arranged ones of said transverse loading ribs arranged at a distance from each other in the direction of travel of a web to define an open space therebetween, machine direction ribs connecting a first one of said successively arranged transverse loading ribs and a second one of said successively arranged transverse loading ribs such that said first transverse loading rib is connected by said machine direction ribs only to said second transverse loading rib, said machine direction ribs being spaced apart from one another to define spaces therebetween, loading means for loading said first and second transverse loading ribs with an adjustable loading force, said loading means comprising two transverse frame beams, and loading hoses for producing a dewatering pressure to dewater the web, one of said loading hoses being arranged on each of said transverse frame beams, the web former further comprising a drainage box placed opposite said forming board on the other side of said carrying and said covering wires, said drainage box comprising a plurality of ribs defining spaces therebetween and means for applying negative pressure into said drainage box, the web being dewatered by the effect of the negative pressure applied into said drainage box, said ribs on said drainage box structured and arranged to operate as back-up members for loading forces provided by said loading hoses, and said forming unit structured and arranged such that in the area of said forming unit dewatering takes place both through said covering wire and through said carrying wire and also toward said forming board through the open space located between said first and second transverse loading ribs of said forming board.

2. Web former as claimed in claim 1, further comprising a suction box located between said interconnected transverse loading ribs in said ribbed shoes, a flexible suction hose connected to and providing negative pressure to said suction box, the negative pressure passing to said suction box causing water to drain toward said forming board.

3. The web former of claim 2, further comprising link means for linking one of said interconnected transverse loading ribs to one of said frame beams, said link means comprising at least one vertical arm connected to said one of said frame beams via joints, a top end of said at least one vertical arm being supported on a rear edge of a trailing one of said interconnected transverse ribs in the running direction of the web.

4. Web former as claimed in claim 1, further comprising suction boxes located in intermediate spaces between adjacent ones of said ribbed shoes, a flexible suction duct connected to and providing negative pressure to each of said suction boxes, the negative pressure introduced into said intermediate spaces causing water to drain toward said forming board.

5. Web former as claimed in claim 1, wherein said transverse loading ribs of said forming board are arranged such that said ribs of said drainage box are placed facing said ribbed shoes and are located in the middle between said transverse loading ribs of said forming board.

6. Web former as claimed in claim 1, wherein said ribs of said drainage box are placed partly or fully opposite to said transverse loading ribs of said forming board.

7. Web former as claimed in claim 1, wherein the run of said twin-wire forming zone is substantially straight in the area of said forming unit.

8. Web former as claimed in claim 1, wherein the run of said twin-wire forming zone is curved in the area of said forming unit such that the center of curvature of said run is at a side of said drainage box of said forming unit.

9. Web former as claimed in claim 1, wherein the run of said twin-wire forming zone is curved in the area of said forming unit such that the center of curvature of said run is at a side of the opposite forming board.

10. Web former as claimed in claim 1, wherein said former is a gap former comprising one or two of said forming units which are located between a first forming roll and a second forming roll or a stationary forming member.

11. Web former as claimed in claim 1, wherein said former is hybrid former, further comprising a single-wire initial forming zone, a headbox, a pulp suspension jet fed out of a discharge opening of said headbox onto said single-wire forming zone, said single-wire forming zone being followed by said twin-wire forming zone, and said twin-wire forming zone having several forming units each identical to said forming unit of claim 1.

12. The web former of claim 1, further comprising link means for linking one of said interconnected transverse loading ribs to one of said frame beams.

13. The web former of claim 12, wherein said link means are arranged in proximity to a plane of said twin-wire forming zone to substantially prevent the generation of torque.

14. The web former of claim 12, wherein said link means comprise vertical arms connected to said one of said frame beams via joints, a top end of said vertical arms being supported on a rear edge of a front one of said interconnected transverse ribs in the running direction of the web.

15. The web former of claim 1, wherein said machine direction ribs are arranged between said loading hoses and said interconnected transverse loading ribs to separate said loading hoses from said interconnected transverse loading ribs.

16. The web former of claim 1, wherein said ribs of said drainage box and said transverse ribs comprise tip edges at a front edge thereof for doctoring water from said covering and carrying wires.

17. The web former of claim 1, wherein said ribbed shoes are separated from one another by transverse gaps.

18. A twin-wire web former in a paper machine comprising a carrying wire, a covering wire, said carrying wire and said covering wire defining a twin-wire forming zone, a forming unit located in said twin-wire forming zone, said forming unit comprising a forming board located on one side of said carrying and said covering wires, said forming board having a plurality of transverse loading ribs and a plurality of ribbed shoes, each of said ribbed shoes comprising at least a pair of successively arranged ones of said transverse loading ribs arranged at a distance from one another in the direction of travel of a web to define a respective open space between respective pairs of successively arranged ones of said transverse loading ribs, machine direction ribs for connecting a first one of said successively arranged transverse loading ribs and a second one of said successively arranged transverse loading ribs, said machine direction ribs being spaced apart from one another to define spaces therebetween, loading means for loading said interconnected transverse loading ribs with an adjustable loading force, said loading means comprising at least two transverse frame beams, and loading hoses for producing a dewatering pressure to dewater the web, one of said loading hoses being arranged on each of said at least two transverse frame beams, link means for linking only one of said interconnected transverse loading ribs to a corresponding one of said at least two transverse frame beams, the web former further comprising a drainage box placed opposite said forming board on the other side of said carrying and said covering wires, said drainage box comprising a plurality of ribs, spaces being located between said ribs, means for applying negative pressure into said drainage box, the web being dewatered by the effect of the negative pressure applied into said drainage box, said ribs on said drainage box structured and arranged to operate as back-up members for loading forces provided by said loading hoses, and said forming unit structured and arranged such that in the area of said forming unit dewatering takes place both through said covering wire and through said carrying wire and also toward said forming board through the respective open space located between respective pairs of successively arranged ones of said transverse loading ribs.

19. The web former of claim 18, wherein said link means are arranged in proximity to a plane of said twin-wire forming zone to substantially prevent the generation of torque.

20. The web former of claim 18, wherein said link means comprise at least one vertical arm connected to said corresponding one of said at least two transverse frame beams via joints, a top end of said at least one vertical arm being supported on a rear edge of one of said interconnected transverse ribs in the running direction of the web.

* * * * *